US006886186B2

(12) United States Patent
Jansen

(10) Patent No.: US 6,886,186 B2
(45) Date of Patent: May 3, 2005

(54) SAFETY DEVICE FOR USE WITH A SPORTS HELMET

(76) Inventor: Cheryl Jansen, 60690 Hopi Ct., Washington Township, MI (US) 48094

( * ) Notice: Subject to any disclaimer, the term of this patent is extended or adjusted under 35 U.S.C. 154(b) by 0 days.

(21) Appl. No.: 10/683,180

(22) Filed: Oct. 10, 2003

(65) Prior Publication Data

US 2004/0073987 A1 Apr. 22, 2004

Related U.S. Application Data

(60) Provisional application No. 60/417,454, filed on Oct. 10, 2002.

(51) Int. Cl.[7] ..... A42B 1/24

(52) U.S. Cl. ..... 2/422; 2/421; 2/DIG. 11; 2/209.13; 2/44; 602/17; 602/19

(58) Field of Search ..... 2/421, 422, 468, 2/209.13, 425, DIG. 11, 44; 128/845, 876; 602/17, 18, 19

(56) References Cited

U.S. PATENT DOCUMENTS

| | | | | | |
|---|---|---|---|---|---|
| 452,206 | A | * | 5/1891 | Aaron | 2/44 |
| 3,925,822 | A | * | 12/1975 | Sawyer | 2/421 |
| 4,007,733 | A | * | 2/1977 | Celeste et al. | 600/594 |
| 4,560,201 | A | * | 12/1985 | Scott | 297/393 |
| 5,199,940 | A | * | 4/1993 | Morris et al. | 602/19 |
| 5,259,833 | A | * | 11/1993 | Barnett | 602/19 |
| 5,685,831 | A | * | 11/1997 | Floyd | 602/19 |
| 6,082,826 | A | * | 7/2000 | Moreno | 297/464 |
| 6,588,022 | B1 | * | 7/2003 | Anders et al. | 2/421 |
| 2004/0068779 | A1 | * | 4/2004 | Duffy | 2/422 |

FOREIGN PATENT DOCUMENTS

FR 2626148 A3 * 7/1989 ..... A42B/3/02

* cited by examiner

*Primary Examiner*—Rodney M. Lindsey
(74) *Attorney, Agent, or Firm*—Gifford, Krass, Groh, Sprinkle, Anderson & Citowski, P.C.

(57) ABSTRACT

The present invention provides a safety device for use with a sports helmet as a means of reducing neck and spinal cord injuries that are common to contact sports. The preferred embodiment of the inventive device is intended for use with a sports safety helmet. The device comprises an elastic cord having a fastening member at a first end that engages a complementary fastening member disposed on the safety helmet. A second end of the elastic cord attaches to an adjustable strap that attaches to a belt disposed on the body of a user. In operation, the device provides resistance to the user's ability to hold his head in a lowered position. It is appreciated that holding the head in an upright position reduces the risk of accidental neck and/or spinal cord injury due to collisions.

6 Claims, 2 Drawing Sheets

SAFETY DEVICE FOR USE WITH A SPORTS HELMET

RELATED APPLICATIONS

This application claims the benefit of U.S. Provisional Application No. 60/417,454 filed Oct. 10, 2002.

FIELD OF THE INVENTION

The present invention provides a device for encouraging a user to maintain good posture. More particularly, the invention provides a safety device that cooperates with a sporting helmet to assist in preventing serious neck and back injuries.

BACKGROUND OF THE INVENTION

Neck and back injuries are a common occurrence in recreational and sports activities, especially contact sports such as football and hockey. Ice hockey, in particular, is one of the most popular team sports in many parts of the world. It is a fast-paced game that combines players of many sizes together on the rink with high skating speeds and fast, furious action.

Hockey is known as a hard-hitting collision sport. Players risk injury from high impact collisions with each other, the rigid boards that mark the boundary of the playing surface, and the goalpost. However, most injuries are caused by deliberate player contact, e.g. checking and collision, as a normal incidence of offensive/defensive play.

The best method of preventing the types of injuries that occur as a result of head checking is to tell players that they should avoid making any contact with another player's head. But in some cases neck and back injuries occur as a result of accidental head-on collisions with players, the boards that surround the rink, or the goalpost. Players are encouraged to attempt to cushion their collisions with structural elements with any part of the body other than the head. In situations where head contact is unavoidable, players are encouraged to keep their heads up so that the brunt of the collision is taken on the forehead or facemask rather than the neck.

In this light, the present invention provides a device that will encourage a player to keep his or her head up in the proper position while on the ice as a means of improving player safety towards preventing the occurrence of neck and back injuries.

SUMMARY OF THE INVENTION

The present invention provides a device to be worn by a user for encouraging a user to keep his or her head in an upright position. More particularly, the invention provides a safety device for use with a sports helmet such that the device provides resistance against a user's ability to hold his or her head down.

The device as according to the invention is for use with a head cover that includes a fastening member that allows for the device to be attached thereto.

The device includes an elastic cord having first and second ends. A first end of the cord includes a fastening member that is a complement to the fastening member on the rear of the head cover for connecting thereto.

The second end of the elastic cord is attachable to one end of a non-elastic strap. The free end of the non-elastic strap is attachable to a belt or other item that is worn on the body of a user.

Preferably, the strap and belt are made adjustable such that a single device can be effectively worn by individuals of different sizes. When worn properly, the device operates to provide resistance against the user attempting to lower his head. Accordingly, the present invention provides a simple and effective device for use with a head cover, such as a safety helmet, that operates to encourage a user to keep the head in an upright position. This in turn will reduce the occurrence of serious neck and spinal cord injuries that frequently occur in contact sports. Further, the invention may be used simply as a device for improving an individual's body posture, which is important for maintaining health and vitality.

BRIEF DESCRIPTION OF THE DRAWINGS

To further describe the nature and objects of the present invention, reference should be had to the following detailed description taken in conjunction with the accompanying drawings in which like parts are given like reference numerals and wherein.

DETAILED DESCRIPTION OF THE DRAWINGS

Figure 1:
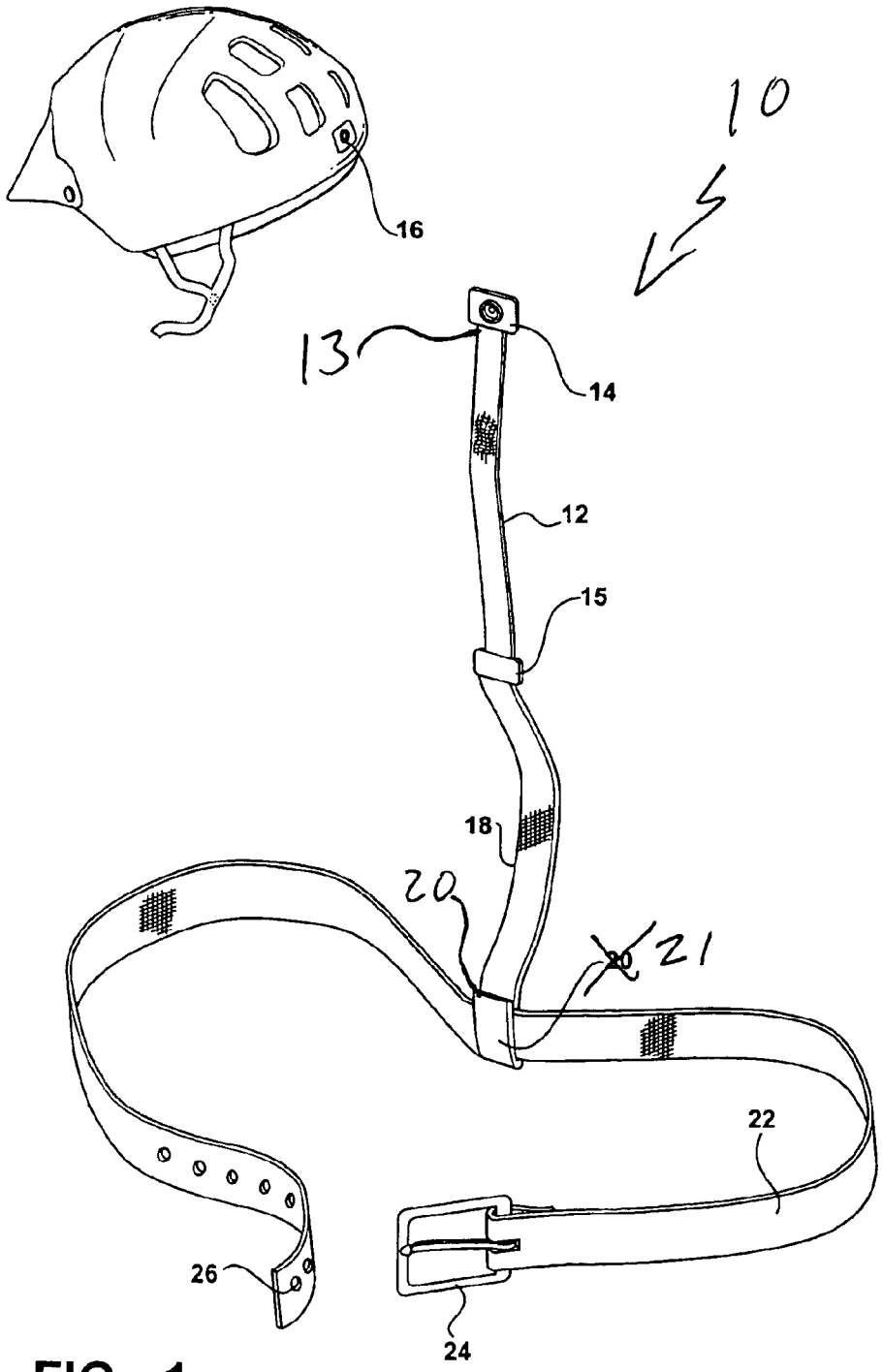
FIG. 1 is a plan view illustration of the safety and posture improving device as according to the invention.

The device according to the present invention is for use with a head cover as illustrated in FIG. 1. In the preferred embodiment, the head cover is a safety helmet most commonly used in contact sports such as ice hockey and football. However, other head covers may be used which satisfy the intended purpose which illustratively includes caps, headbands, head wraps, hats or other items that can be worn about the head or used to cover a portion thereof.

The head cover according to the invention includes a fastening member 16 disposed on a rear portion thereof for engaging a complementary fastening member attached to the device 10 to be described hereinafter. In the preferred embodiment, the fastening member 16 attached to the helmet is made of Velcro, but other fasteners may be used which illustratively includes snap fittings, buckles, clips, tie straps, adhesive materials, pinnings and the like.

As further illustrated in FIG. 1, a preferred embodiment of the device 10 includes an elastic cord 12 having first and second ends 13 and 15, respectively. A fastening member 14 is attached to a first end 13 of the elastic cord 12 for engaging the fastening member 16 on the head cover. The elastic cord 12 may be made of any elastically resilient material such as rubber and synthetic elastic fibers. It is appreciated that the device 10 may be entirely constructed of elastic or non-elastic material without exceeding the scope of the invention. However, the elastic cord 12 is provided in conjunction with the non-elastic strap 18 such that the user experiences resistance to head movement rather than strict limitation to movement as would be provided by a completely non-elastic strap.

In the preferred embodiment, the elastic cord 12 is attachable at a second end 15 to a non-elastic strap 18 that includes a free end 20. Preferably, the strap 18 is made of a lightweight woven or non-woven material such as nylon, leather or durable plastic material. Most preferably, the strap 18 includes an adjustment member 19 whereby the total length of the elastic cord 12 and the strap 18 may be adjusted accordingly to accommodate for differences in size of individual users.

Illustratively, the non-elastic strap 18 includes a loop 21 formed at its free end 20 for cooperating with a belt 22 that provides a means of securing the device 10 to the body of a user. The belt 22 is dimensioned to be received through the loop 21 and includes fasteners at its opposing ends that allow for the belt to be adequately adjusted and secured to the body of a user. The belt 22 may be made from natural or synthetic materials such as leather, cloth or plastic or other suitable material. Additionally, the strap 18 may include a free end 20 that provides a fastener that is attachable to a belt previously disposed on a user. Illustratively, such a fastener may include the use of Velcro, snap fasteners, clips or other fastening means known to those skilled in the art suitable for such purpose.

Figure 2:
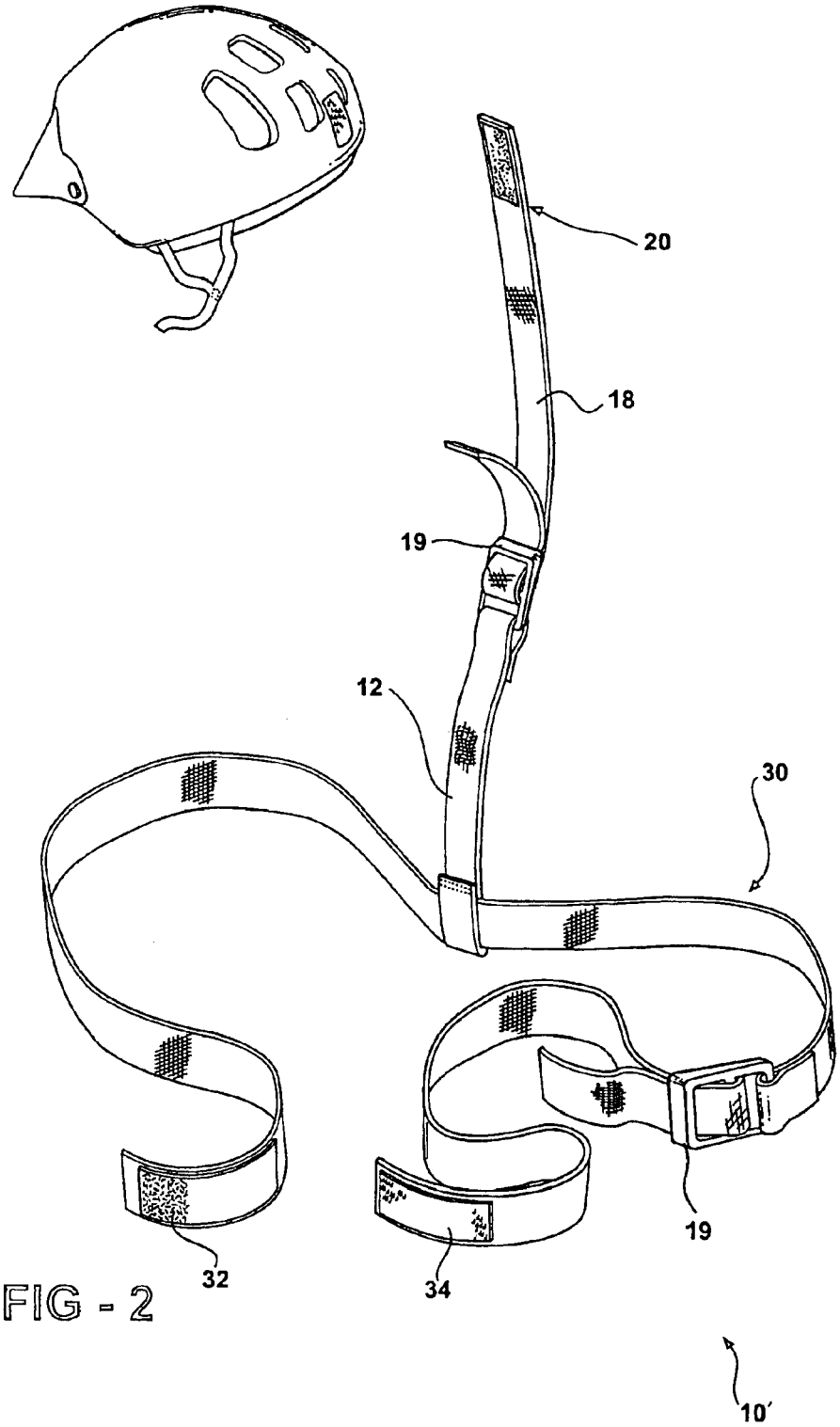
FIG. 2 illustrate an alternative embodiment of the safety and posture improving device as according to the invention.

In an alternative embodiment 10' shown in FIG. 2, the free end 20 may be adapted to attach to a garment or other items worn by the user illustratively including pants, safety pads, or an athletic supporter, via Velcro, snap fasteners or the like. The device 10' includes a headband 30 to be worn about the user's head in communication with the elastic cord 18. Preferably, opposing ends 32, 34 of the headband 30 include complementary fastening means for securing the device 10' about the user's head. Most preferably, the headband 30 includes an adjusting means 19 for accommodating user's of various head sizes. It is appreciated that the headband 30 may be formed of an elastically resilient material operative to be slip fitted about the head rather than having selectably attachable opposing ends 32, 34 as described above.

In a preferred embodiment, a device 10 according to the invention is worn such that the first end 14 of the elastic cord 12 is attached to the fastening member 16 on a rear portion of the user's head cover. The belt 22 is preferably secured to the body of a user by employing the complementary fastening means 24 and 26. The device 10 is properly fitted to the user when the combination of the elastic cord 12 and non-elastic strap 18 lies substantially aligned and adjacent to the user's spine. When worn in this manner, the device 10 operates to resist against the user's attempts to put his head down but ceases with such resistance when the user keeps his head up in a proper position. As such, the device 10 acts as a reminder to the user to keep his or her head up such that proper posture is maintained. The primary purpose of the present device is to reinforce to players of sports such as ice hockey and football the importance of keeping their heads up while participating in practice and play. This reduces the risk of serious neck or spinal cord injuries that result from intentional or accidental collisions.

Another benefit of the device is that it teaches players to use their eyes rather than to move their head, which allows them to react faster to their environment. Still further, the device conceptually enhances a user's ability to stay on his feet. It is appreciated that gravity will operate on a mass to pull it down to the surface of the earth. As the area of a mass increases, the gravitational pull of the earth on that mass also increases. Thus, when one leans his head down, he effectively increases the mass area upon which the earth's gravitational pull can act upon. From this it can be reasoned that a person that keeps his head down may have a greater chance of falling to the ground after a stumble than a person that keeps his head up.

While the invention has been described with regard to its use in football and hockey, it can also be used in other contact and non-contact sports including ice skating, roller skating and in any other activity in which the position of a user's head needs to be controlled for safety or good posture.

From the foregoing figure and description thereof is provided an illustration of the preferred embodiment and the concepts of this invention. It is to be understood that various changes in the shape, size, arrangement and materials of the parts may be resorted to without departing from the spirit of the invention or scope of the claims as presented.

I claim:

1. A safety device for use with a head cover, said device comprising:

an elastic cord having first and second ends;

a fastening member fixed to said first end of said elastic cord operative to engage a complementary fastening member disposed on a back side of said head cover;

an adjustable and non-elastic strap attached to said second end of said elastic cord, said adjustable strap having a free end that forms a loop; and a belt having opposing ends and dimensioned to cooperate with said loop of said adjustable strap, said opposing ends including complementary fasteners operative to secure said belt to a user.

2. A safety device for use with a sports helmet, said device comprising:

an elastic cord having first and second ends;

a fastening member fixed to said first end of said elastic cord, said fastening member operative to engage a complementary fastening member disposed on a back side of said helmet;

a non-elastic strap attachable to said second end of said elastic cord, said strap having a free end which is attachable to an article disposed on the body of a user.

3. The device of claim 2 wherein the article is a belt.

4. The device of claim 2 wherein the article is clothing.

5. A device for improving a user's posture, said device designed to cooperate with a head cover worn by the user, said device comprising:

an elastic cord having first and second ends;

a fastening member fixed to said first end of said elastic cord, said fastening member operative to engage a complementary fastening member disposed on a back side of said head cover;

a strap attachable to said second end of said elastic cord, said strap having a free end which is attachable to a belt disposed on the body of a user.

6. A device for use in improving a user's posture comprising:

a headband having selectably attachable opposing ends and operative to be disposed about the user's head;

an elastic cord having first and second ends, said first end attached to said headband between said opposing ends such that said elastic cord aligns with the user's spine when said headband is disposed about the user's head; and a non-elastic strap attached to said second end of said elastic cord, said non-elastic strap having a free end that is attachable to an article disposed on the user's body.

* * * * *